US007035171B2

(12) United States Patent
Hurni et al.

(10) Patent No.: US 7,035,171 B2
(45) Date of Patent: Apr. 25, 2006

(54) TIMEPIECE PROVIDED WITH INTERCHANGEABLE DIAL

(76) Inventors: David Hurni, Rue Numa-Droz 89, CP 782 CH-2301, La Chaux-de-Fonds (CH); Jacques Marchand, Rue Numa-Droz 89, CP 782 CH-2301, La Chaux-de-Fonds (CH)

( * ) Notice: Subject to any disclaimer, the term of this patent is extended or adjusted under 35 U.S.C. 154(b) by 0 days.

(21) Appl. No.: 10/704,157

(22) Filed: Nov. 10, 2003

(65) Prior Publication Data

US 2004/0141423 A1 Jul. 22, 2004

Related U.S. Application Data

(63) Continuation of application No. PCT/CH01/00291, filed on May 11, 2001.

(51) Int. Cl.
*G04B 19/14* (2006.01)
*G04B 37/00* (2006.01)

(52) U.S. Cl. ..... 368/232; 368/228; 368/276; 368/295

(58) Field of Classification Search ..... 368/80, 368/228, 232, 236, 276, 294, 295
See application file for complete search history.

(56) References Cited

U.S. PATENT DOCUMENTS

| | | | | |
|---|---|---|---|---|
| 2,132,051 | A * | 10/1938 | Schuttenberg | 40/489 |
| 4,660,992 | A | 4/1987 | Paul et al. | |
| 5,008,869 | A * | 4/1991 | Dweck | 368/228 |
| 5,018,118 | A * | 5/1991 | Ross | 368/228 |
| 5,793,710 | A | 8/1998 | Jacobi, Jr. | |
| 6,118,735 | A | 9/2000 | Li | |

FOREIGN PATENT DOCUMENTS

| | | |
|---|---|---|
| CH | 501 258 | 10/1968 |
| FR | 2 614 443 | 4/1987 |
| FR | 2 746 499 | 3/1996 |

* cited by examiner

*Primary Examiner*—Kamand Cuneo
*Assistant Examiner*—Jeanne-Marguerite Goodwin
(74) *Attorney, Agent, or Firm*—Blank Rome LLP

(57) ABSTRACT

A timepiece has a portion of its case body capable of being removed from the rest of the case body. The removable portion bears an interchangeable dial plate. The device is configured in such a manner that the dial plate never serves as a stopping abutment when it is inserted in the timepiece. A closure device allows the interchangeable dial to be suitably fastened to the watch.

26 Claims, 6 Drawing Sheets

TIMEPIECE PROVIDED WITH INTERCHANGEABLE DIAL

This application is a continuation of application Ser. No. PCT/CH01/00291 filed on May 11, 2001.

BACKGROUND OF THE INVENTION

1. Field of the Invention

The present invention concerns a timepiece, in particular a wristwatch, whose dial can be exchanged. It also concerns a dial designed for a timepiece with interchangeable dial.

2. Description of the Related Art

The dial of a watch is one of the main pieces determining the aesthetic aspect of the watch. Consequently, rather than owning several different watches, it can be interesting for the user to be able to change the dial of his watch in order to modify its aspect according to circumstances and fashion. Thus, the owner of a watch according to the invention could have for example a dial reminiscent of the sport he engages in as well as another dial adapted to his job and yet other dials devised for other circumstances of his life.

Several attempts have been made to propose watches of this type. For example, documents FR-A-2.746.499 and U.S. Pat. No. 6,118,735 each describe a timepiece comprising a lateral slit allowing a removable dial to be inserted or removed. In the pieces of this type, the slit on the one hand always remains visible, which is not aesthetically pleasing, and on the other hand always remains accessible and at least partially open, which allows humidity and dust to penetrate under the watch's glass. Furthermore, the systems for fastening the dial to the case being very crude and poorly reliable, the risk of losing the dial when shaking the wrist is not negligible.

The watches described in FR-A-2.614.443 and U.S. Pat. No. 4,660,992 comprise a lateral portion of the case body, mounted pivotally by one extremity on the rest of the case body, so as to free or hide a lateral slit for inserting or removing the dial. Although the aesthetic aspect is more elaborate than in the preceding watches, fastening a relatively large portion of the case body onto the rest of the case body by means of a hinge of small dimensions constitutes a weak point in this kind of watch. Indeed, as soon as the case body is open, and in view of the considerable leverage exerted by the open lateral portion of this case body on the hinge, the latter is very quickly subjected to deformations which makes it impossible to close the watch again. Furthermore, such a device does not allow the dial's insertion slit to be easily made tight.

Patent U.S. Pat. No. 5,793,710 describes a watch having an interchangeable dial that is flexible and provided with a narrow slit that can deform to allow the hands' axis to pass. This way of proceeding risks damaging the hands' axis if the dial is changed often. Furthermore, since the dial is flexible and can easily deform, this device requires a transparent protection to be interposed between the dial and the hands in order to protect the latter. The closure device described in this document comprises two elastic fastening devices placed at the two extremities of a detachable portion of the case body to which the interchangeable dial is fastened. This arrangement is difficult to use inasmuch as it is necessary to operate simultaneously two push buttons of very small dimensions.

SUMMARY OF THE INVENTION

It is thus an aim of the present invention to propose a timepiece provided with an interchangeable dial and which is improved over the prior art.

It is another aim of the invention to propose a timepiece provided with an interchangeable dial and having a dial exchange device that can be made tight so as to prevent the penetration of humidity and dust.

It is another aim of the invention to propose a timepiece provided with an interchangeable dial and having a dial exchange device that is sturdy and reliable.

It is another aim of the invention to propose a timepiece provided with an interchangeable dial and having a dial fastening device that is simple, easy to use and reliable.

It is another aim of the invention to propose a timepiece provided with an interchangeable dial and having a high aesthetic value.

Finally, it is another aim of the invention to propose an interchangeable dial designed for a timepiece with interchangeable dial.

These various aims are achieved by a timepiece having the characteristics mentioned in claim 1 as well as by an interchangeable dial having the characteristics of claim 23. Variant and specific embodiments are furthermore described in the dependent claims.

BRIEF DESCRIPTION OF THE DRAWINGS

Several particular embodiments of a timepiece with interchangeable dial are described hereafter, this description having to be read in consideration of the attached drawings comprising the figures, in which.

DETAILED DESCRIPTION OF THE PREFERRED EMBODIMENTS

Figure 1:
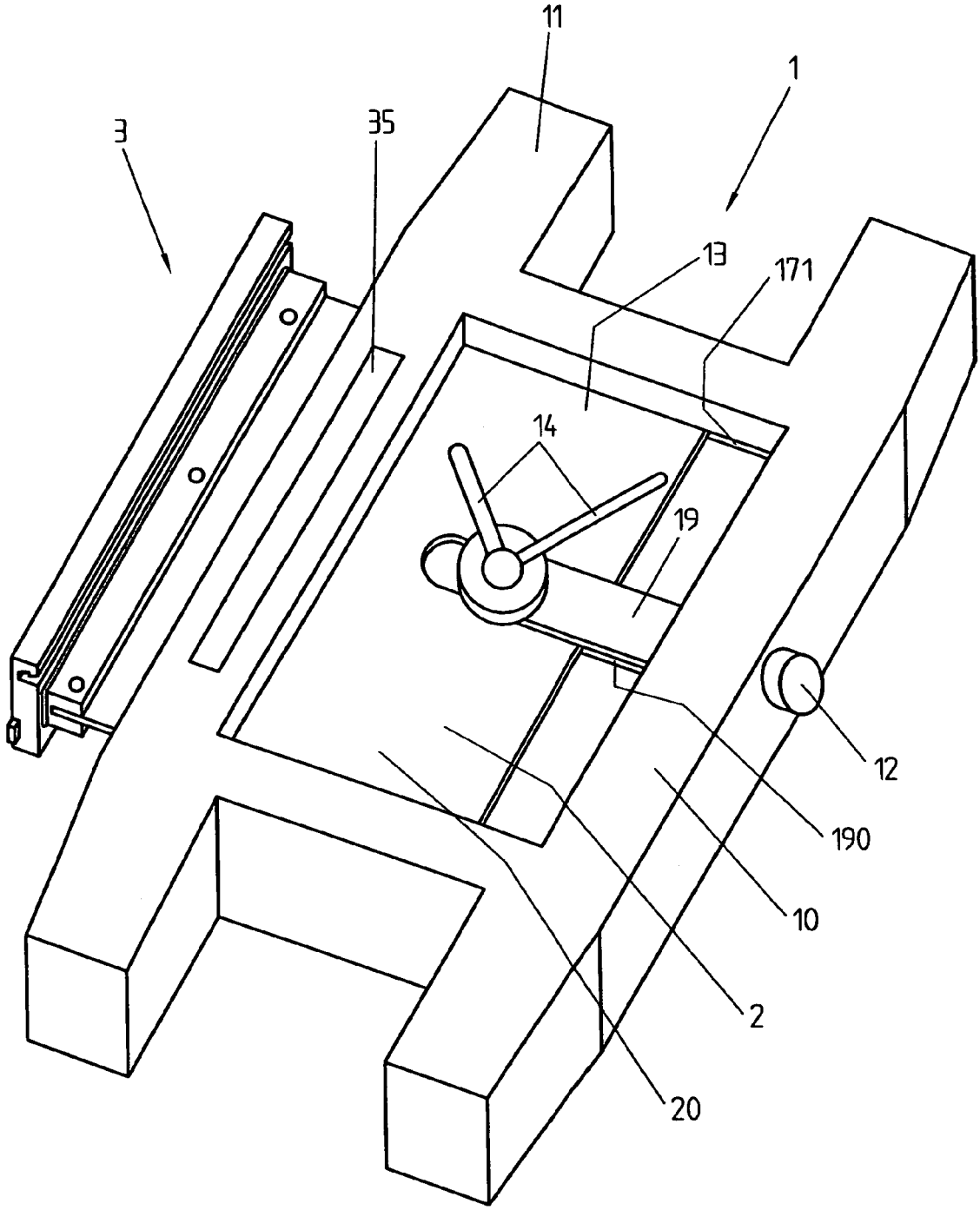
FIG. 1 shows a perspective view of a watch with interchangeable dial according to a first embodiment of the invention.

FIG. 1 represents a watch 1 shown in perspective, the watch being here of square shape and comprising notably a case body 10, two horns 11 for fastening a bracelet (not represented) onto each of the two opposite sides of the case body, possibly a winding crown 12, a glass 13 and a set of hands 14. The dial 2 of the watch 1 is interchangeable, i.e. the plate 20 constituting the dial and visible through the glass 13 can be removed through one side of the case body, here the side opposite that provided with the winding crown 12, and exchanged by another plate 20 having for example another background than that of the plate that has been removed. The dial plate 20 is fastened to means 3 for positioning and fastening the interchangeable dial 2 in the watch 1, of which several embodiments will be described further below. An actuating means 35 allows the positioning and fastening means 3 to be released from the rest of the watch, respectively these two parts to be fastened together. A mark support 19, whose use will also be described further below, is visible through the glass 13.

Figure 3:
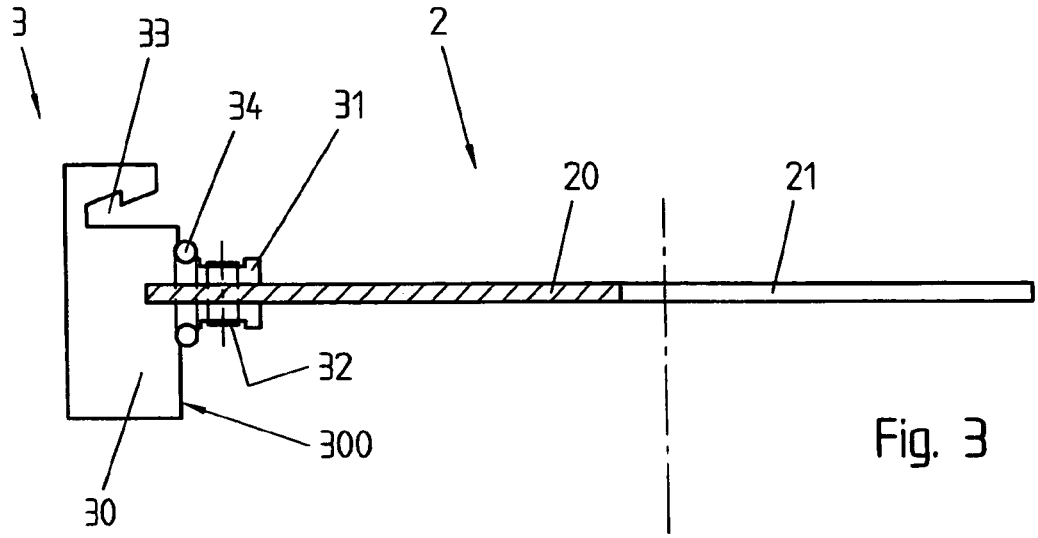
FIG. 3 shows a side view of the dial of the preceding figure.
Figure 2:
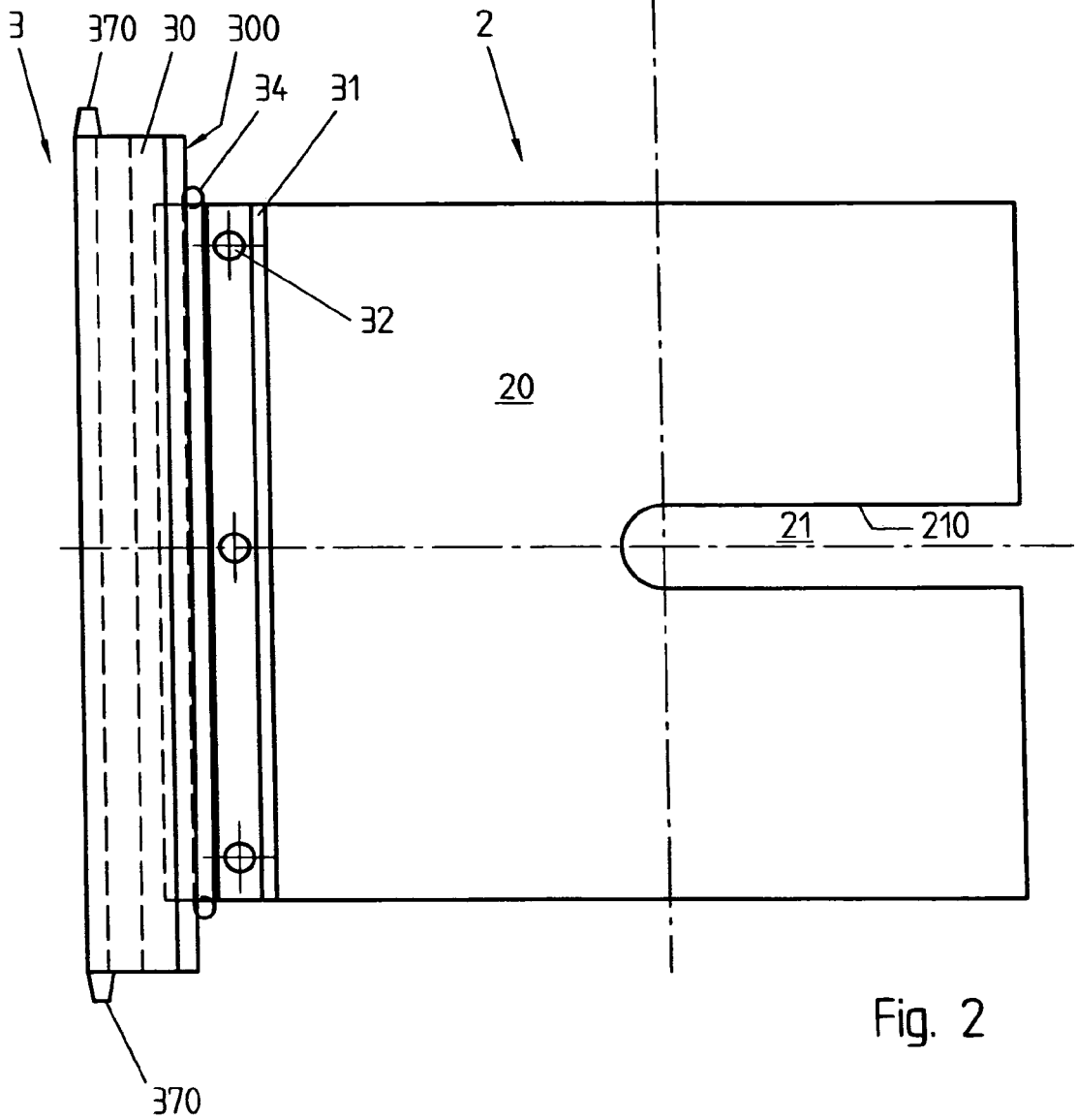
FIG. 2 shows a horizontal projection view of an interchangeable dial with a first shape, associated to a fastening means according to the first embodiment of the invention.

FIGS. 2 and 3 represent an interchangeable dial 2 constituted of a dial plate 20 having a first shape, associated to a positioning and fastening means 3 according to a first embodiment.

The plate 20 has here an external shape that is essentially quadrangular, designed for a dial of square or rectangular shape, and comprises an opening 21 in the shape of a large slit whose sides 210 are parallel to allow the axis of the hands to pass, as will be seen further below.

The positioning and fastening means 3 represented here is constituted of a portion of the case body having here an essentially parallelepipedal, bar shape 30, provided on its face 300 turned towards the interchangeable dial 2 with a fastening piece 31 onto which the dial plate 20 can be fastened by its edge opposite the opening 21, by permanent or detachable fastening means 32. The case 30 comprises an opening 33 of appropriate shape, placed on its face 300, said opening 33 being designed to work with a closure means that will be described further below in relation with FIG. 4. The positioning and fastening means 3 can favorably be complemented with a tightening means 34, here an O-ring gasket placed in a groove provided in the side 300 of the case 30 bearing the fastening piece 31 and/or in a groove provided in said fastening piece 31.

Figure 4:
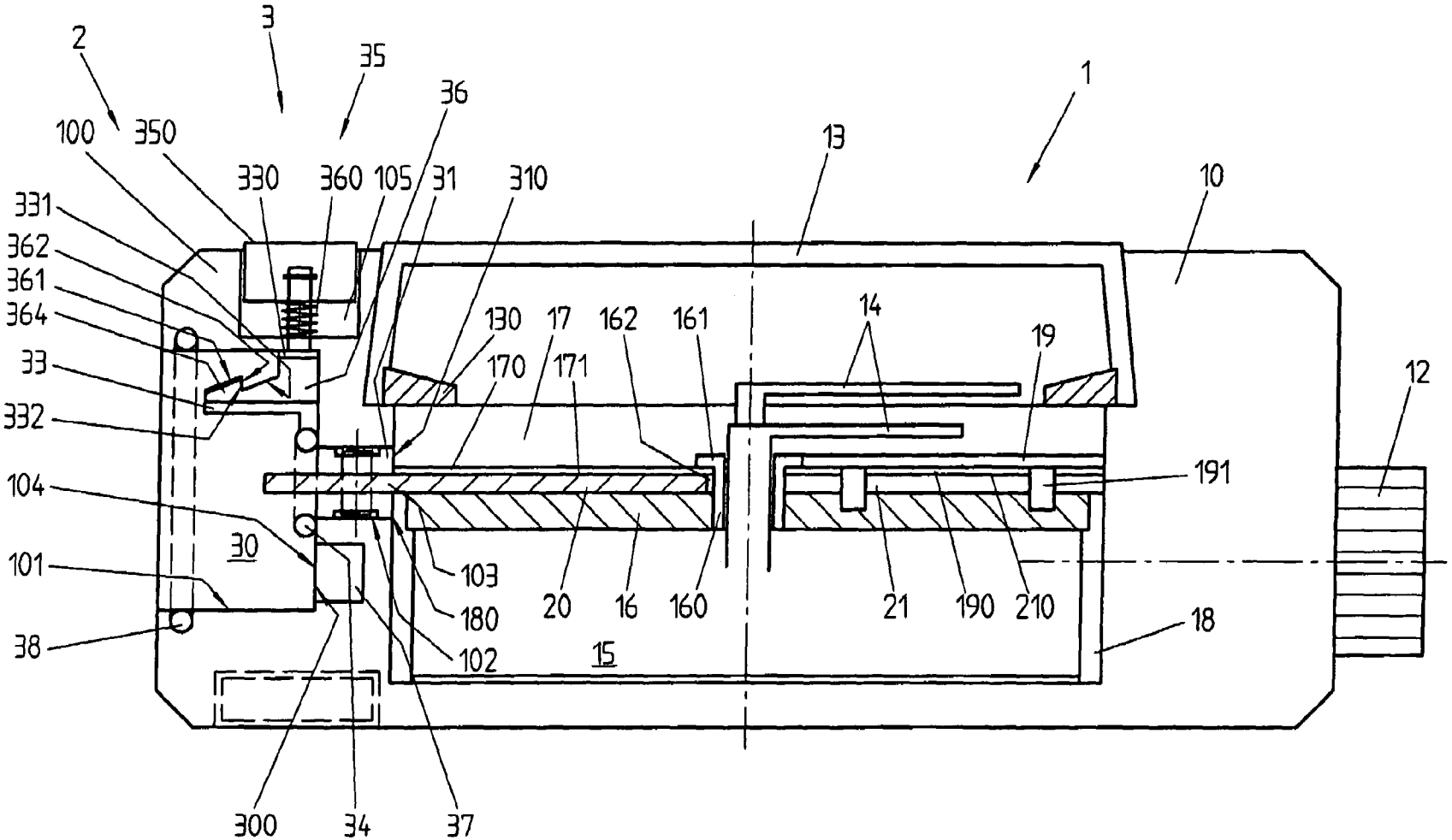
FIG. 4 shows a cross section view of a watch with interchangeable dial according to the invention.

FIG. 4 shows a watch 1, seen in cross-section, said watch being provided with an interchangeable dial 2 as described here above.

In addition to the elements described in respect of FIG. 1, the watch 1 comprises a movement 15 of mechanical or electronic type, for example a quartz movement, a movement cover 16 of particular form the usefulness of which will be described further below, bearing a ring 17 fastened in a conventional way under the class 13 and its fixing ring 130, as well as a casing ring 18 serving to hold in place the movement 15 and the movement cover 16. The watch is complemented with a mark support 19, designed to hide the opening 21 of the dial plate 20, fastened in a conventional way, for example through feet 191 inserted in suitable lodgings of the movement cover 16.

In FIG. 4, it can be seen that the side 100 of the case body 10 opposite the side provided with the winding crown 12 comprises a first lodging 101 for accommodating the removable portion of case body, respectively the case body 30 itself, from the positioning and fastening means 3, a second lodging 102 adjoining the first lodging 101 for accommodating the fastening piece 31 as well as a slit 103 placed on the side of the lodging 102 turned towards the watch's center for allowing the dial plate 20 to pass. A corresponding slit 170 is provided in the flange 17 for the same use.

In order to insert an interchangeable dial 2 in a watch 1, the free extremity of the dial plate 20 is first inserted in the first lodging 101, then in the second lodging 102, then in the slits 103 and 170 before sliding then over the movement cover 16. This sliding is continued until a portion of the positioning and fastening means 3 abuts against a corresponding portion of the case body 10 or any other portion of the watch 1. To this effect, it is possible to design at least one portion of the side 300 of the case 30 turned towards the center of the watch 1 to serve as end of run abutment against at least one portion of the side 104 turned towards the outside of the lodging 101. It is also possible to design at least one portion of the side 310 of the fastening piece 31 turned towards the center of the watch 1 to serve as end of run abutment against at least one portion 180 of the casing ring 18. Thus, the insertion of the dial plate 20 into the watch 1 is limited only by a resting surface 300 or 310 of the positioning and fastening means 3, no portion of the dial plate 20 being used for this.

The closure means 35 of this embodiment is constituted of a push button 350 lodged in a hollow 105 placed here on the upper part of the portion 100 of the case body 10. The push button 350 is connected to a closure piece 36 of suitable shape and serving as latch that, together with the opening 33 provided in the case 30, allows the interchangeable dial 2 to be locked in mounted position on the watch 1. In the represented example, the assembly of push button 350 and closure piece 36 is mounted on a spring means, for example on one or several coil springs 360. The closure piece 36 comprises notably a first inclined face 361 designed to work with a side 331, of same incline, of the opening 33 as well as a stopping side 362 designed to abut against a corresponding side 443 of the opening 33. It will be understood that through this device, by pressing on the push button 350, the spring or springs 360 are pushed, thus freeing the side 362 from its locked position and allowing the case 30 respectively the interchangeable dial 2 to be extracted. When the dial 2 is inserted, the inclined sides 361 and 331 work together to have the closure device 35 snap in. Advantageously, the assembly of push button 350 and closure piece 36 comprises at least one gasket 330 designed to ensure that the device is tight. When the closure has been unlocked as indicated here above, the sealing gasket 34 can have sufficient flexibility for slightly pushing the case 30 outside its lodging in order to allow it to be grasped and extracted completely. In the case where the gasket's flexibility is not sufficient for this, the device is advantageously complemented by a spring means, for example a spring blade 37 acting against the case's side 300 to push it outwards. A grasping means, for example a protrusion 370 (see FIG. 3) or a notch on each of the extremities of the case 30 allows it to be easily grasped without risk of scratching it.

FIG. 4 shows an embodiment where the push button 350 is placed on the watch's upper side, respectively on the side comprising the glass 13, but it would be just as well possible to place it on the watch's lower side, as suggested in discontinued lines in FIG. 4.

If necessary, in order to improve the watch's tightness, it is possible to place a sealing gasket 38 in a groove provided on the periphery of the lodging 101.

In FIG. 4, the movement cover 16 can be seen to comprise a tube 160 around the axes of the hands' wheel 14, this tube 160 comprising a collar 161 in the shape of a circular crown, defining a lodging 162 comprised between the central portion of the movement cover 16 and the lower part of the collar 161, around the tube 160. Furthermore, the flange 17 comprises on the entire portion of its inside periphery that does not comprise the insertion slit 170, a lodging 171 designed to receive the external peripheral edges of the dial plate 20, of which a portion is also visible in FIG. 1. A similar lodging 190, also partially visible in FIG. 1, is provided on the two sides of the mark support 19 adjoining the edges 210 of the opening 21 of the dial plate 20. The lodgings 162, 171 and 190 described here above are sized to that no portion of the dial plate 20 abuts at the end of run against any portion whatsoever of one of these lodgings. The function of these lodgings is double, first to prevent the dial plate 20 from bulging by restricting its displacement towards the watch's glass, the collar 161 being particularly designed to avoid a deformation of the central portion of the dial plate 20 which could then come into contact with the hands 14, causing either a hand or the dial plate to become damaged. Furthermore, these lodgings 162, 171 and 190 serve to hide the extreme edges of the dial plate 20 as well as of the opening 21, which improves the aesthetic aspect of the dial as seen through the glass 13.

As the dial plate 20 is not subjected to any mechanical effort nor to any shock during its insertion or removal, this plate can be as thin as desired, and could even be of a non-rigid material.

Figure 5:
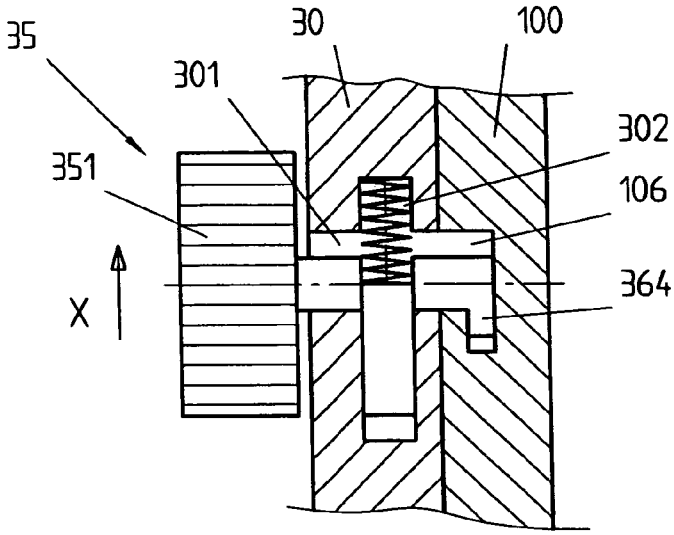
FIG. 5 shows another embodiment of a fastening device of an interchangeable dial.

Another embodiment of a closure means 35 is represented in FIG. 5.

The push button 351, of any shape whatsoever but having advantageously the same shape as a winding crown, is placed facing the portion 100 of the case body designed to receive the removable portion respectively the case 30 as previously described. The push button 351 can be displaced along the arrow, driving a piece in the shape of a latch 364, sliding in two grooves 301 and 106 provided respectively in the case 30 and the case body portion 100. The latch 364 and the groove 106 are formed in such a manner that for one position of the latch 364 in the groove 106, the case 30 is locked in position against the case body portion 100, whereas for another position of the latch 364, the case 30 is unlocked, allowing the interchangeable dial to be removed. The case 30 can further comprise a lodging 302 for a spring and a sliding piece allowing the device to be maintained in locked position.

Figure 6:
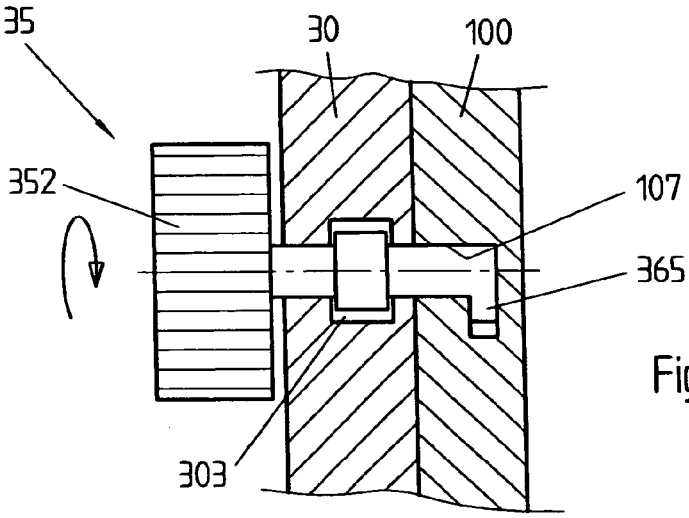
FIG. 6 shows yet another embodiment of a fastening device of an interchangeable dial.

According to yet another embodiment of the closure means 35 shown in FIG. 6, the push button 352 pivots around an axis mounted in the case 30, the opposite extremity of said axis bearing a latch 365. As previously, the case body portion 100 comprises a lodging 107 of a shape such that for one angular position of the latch 365, the case 30 is locked in position against the case body portion 100, whereas for another angular position of the latch 365, the case 30 is unlocked, allowing the interchangeable dial to be removed. The case 30 can further comprise a lodging 303 for a spring device allowing the device to be maintained in locked position. Advantageously, the push button 352 will have the same shape as the winding crown facing it.

Figure 7:
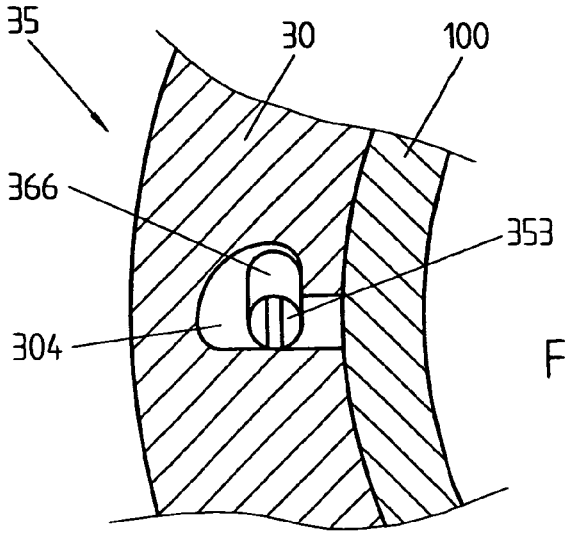
FIG. 7 shows yet another embodiment of a fastening device of an interchangeable dial.

FIG. 7 shows a closure means 35 that can be actuated from the bottom of the watch. A latch 366 is capable of pivoting in a lodging 304 of the case 30 between a closed position, as represented in the figure, and an open position where the case 30 is disunited from the case body portion 100. Advantageously, the axe 353 bearing the latch 366 is level with the bottom of the watch's casing and comprises a groove so that it can be actuated with a screwdriver.

Advantageously, the closure means 351, 253 and 353 that have just been described are also provided with tightening means known in the art, such as anti-dust gaskets or covering caps, not represented in the figures.

Figure 8:
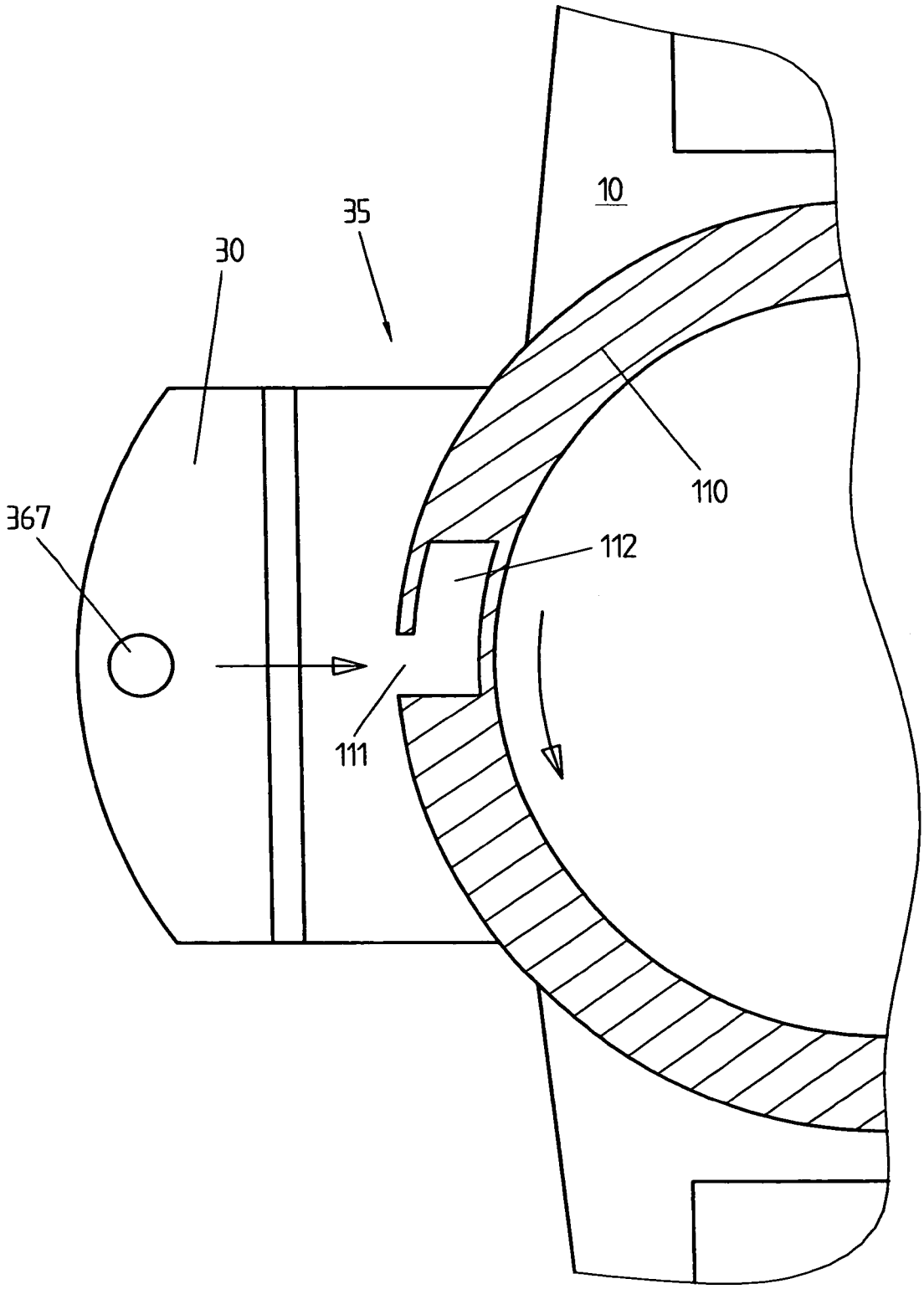
FIG. 8 shows yet another embodiment of a fastening device of an interchangeable dial.

In the embodiment of FIG. 8, the closure means 35 is constituted by a pivoting bezel 110 mounted in a known fashion on the upper portion of the case body 10 surrounding the watch glass. The pivoting bezel comprises an opening 111 corresponding to a hollow 112. A protruding block 367 is mounted on the upper side of the case 30. According to a first position of rotation of the bezel, it is possible to insert the block 367 in the opening 222 and then, after having pushed the case 30 in resting position against the case body portion 100, to make the bezel pivot in order to lock the block 367 in the hollow 112. The opposite movement allows the case 30 resp. the interchangeable dial to be unlocked.

Figure 9:
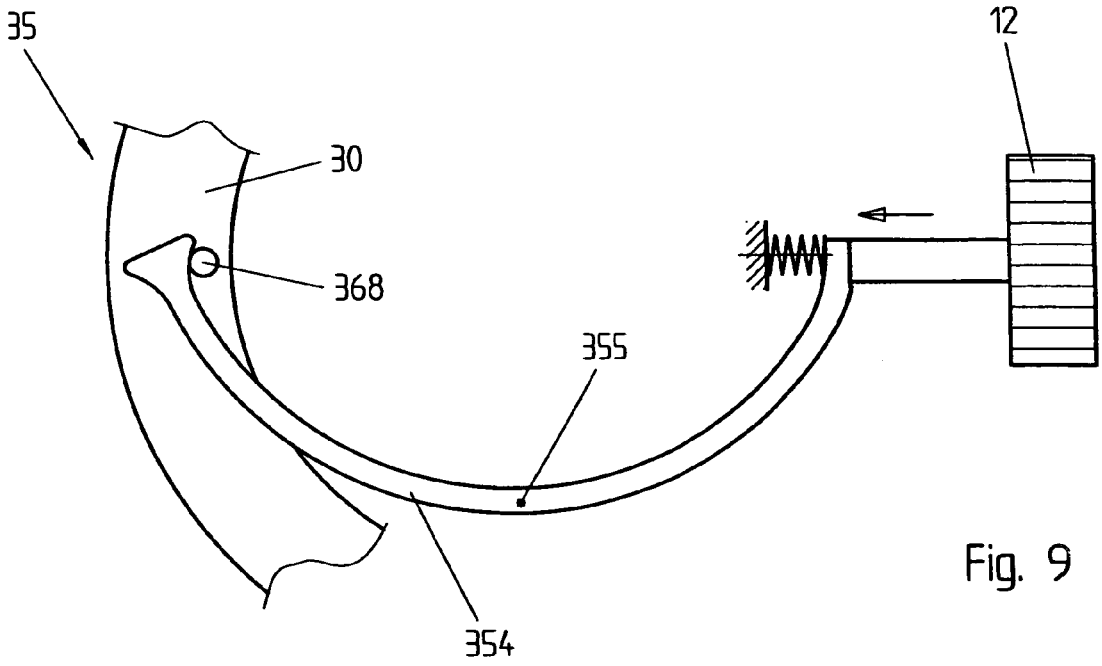
FIG. 9 shows yet another embodiment of a fastening device of an interchangeable dial.

FIG. 9 shows yet another closure means 35 actuated directly by the winding crown 12. A pressure on the crown 12 actuates the lever 354, which pivots around the axis 355 to free the peg 368 mounted protrudingly on the case 30. The lever 354 is held in locking position by a spring. The shape of the extremity of the lever 354 working with the peg 368 is such that when the interchangeable dial is inserted into the watch, the peg 368 pushes back the lever 354 that then locks it under the effect of the spring. Preferably, the stem of the crown 12 is also provided with the usual tightening means.

According to the embodiment of FIG. 9, the winding crown 12 is pushed in order to unlock the interchangeable dial; other variant embodiments are obviously conceivable in which another movement must be impressed to the crown 12 for unlocking.

In the examples of FIGS. 7, 8 and 9, the watch is of circular shape; consequently, the removable case body portion 30 no longer has the shape of a case, as previously, but the shape of a crown segment.

Figure 10:
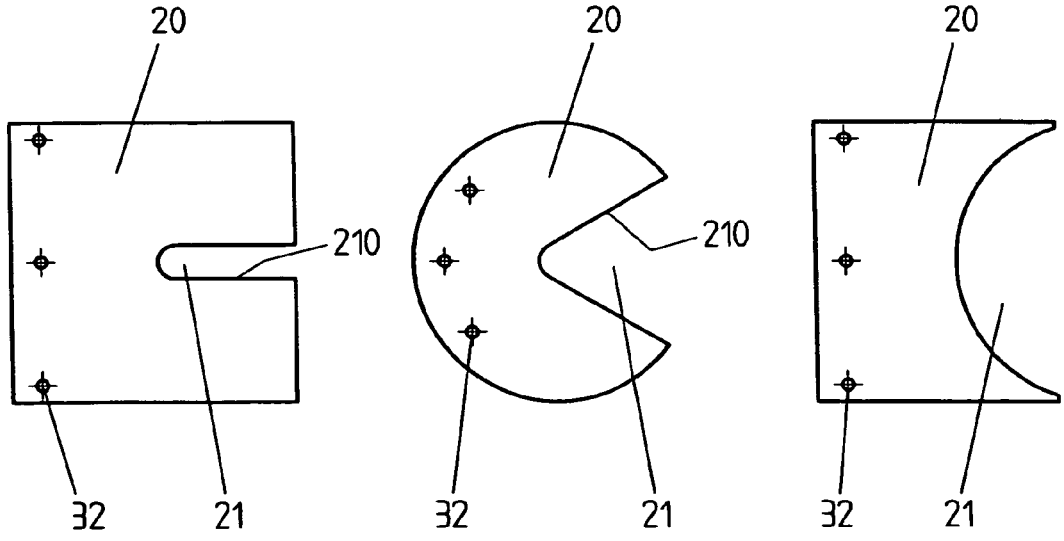
FIG. 10 shows different shapes of an interchangeable dial.

FIG. 10 shows, by way of non-limiting example, some possible shapes of the dial plate 20. The plate on the left is similar to the one that is described in FIGS. 2 and 3, of quadrangular shape and comprising an opening 21 with two parallel edges. The plate 20 represented in the middle is designed for a circular dial; it has an opening 21 whose two edges 210 are oblique to one another. The plate 20 on the right has an opening 21 in a curved arc shape. It must be understood here that it is possible to have a dial plate 20 adapted to the shape of the watch, for example quadrangular, round or of any shape in which an opening 21, itself of any suitable shape, is provided for allowing the axis of the hands to pass, the shape of the opening 21 being adapted to that of the mark support fastened to the movement cover.

Preferably, the owner of a watch with interchangeable dial will acquire a plurality of dial plates 20, of a shape adapted to that of his watch, each of said plates bearing a different background and/or marking. Through the fastening means 32, it is possible to install a new dial plate 20 on a fastening means 3, according to one or the other of the embodiments previously described and then to slide this new dial into the watch as described.

The invention claimed is:

1. A timepiece with interchangeable dial, comprising:

a case body with a removable case body portion, said case body portion being fastened to the rest of said case body through a fastening means allowing said case body portion to become disunited from the rest of said case body, an interchangeable dial fastened to said removable case body portion, and a single, releasable button, wherein said fastening means can be actuated by said single releasable button only, so as to fasten said case body portion to said case body in a first state and to release said case body portion from said case body in a second state.

2. The timepiece of claim 1, wherein said fastening means comprises a latch working with a lodging in such a manner that for a first position of the latch in the lodging, the removable case body portion is fastened to the rest of the case body and for a second position of the latch in the lodging, the removable case body portion is free relative to the rest of the case body.

3. The timepiece of claim 2, said latch being placed on a fixed portion of the case body whereas said lodging is provided in said removable portion of the case body.

4. The timepiece of claim 3, the button for actuating said latch being a push button placed on an upper or lower side of the fixed portion of the case body and acting by pressure on latch.

5. The timepiece of claim 3, the latch being a pivoting rod reaching a portion of the casing bottom and provided with a groove allowing it to be actuated in rotation by a screwdriver.

6. The timepiece of claim 2, the latch being placed on said removable portion of the case body whereas said lodging is provided in a fixed portion of the case body.

7. The timepiece of claim 6, the latch being actuated in rectilinear displacement by a push button.

8. The timepiece of claim 6, the latch being actuated in rotation by a rotation button.

9. The timepiece of claim 6, the latch having the shape of a winding crown.

10. The timepiece of claim 1, wherein said fastening means comprises a fastening piece fastened to the removable case body portion designed to work with a button that is an integral part of said timepiece.

11. The timepiece of claim 10, the button being a winding crown of said timepiece, acting through a transmission means on said fastening piece to free or lock said removable case body portion according to the position of the winding crown.

12. The timepiece of claim 1, the button being provided with sealing fittings.

13. The timepiece of claim 1, further comprising a spring means capable of holding said fastening means in locking position of said removable case body portion.

14. The timepiece of claim 1, said removable case body portion comprising at least one resting surface designed to work with a corresponding resting surface of the remaining timepiece in order to restrict the movement for inserting the dial in order to prevent any stopping of the insertion movement exerted directly onto said dial.

15. The timepiece of claim 14, further comprising a watch glass, a movement cover, a flange placed on the periphery of the movement cover visible through the glass as well as a mark support placed on a portion of the movement cover facing the axis of the hands opposite that which adjoins the removable case body portion, said flange as well as said mark support being each provided with a peripheral groove designed to receive the edge of the dial.

16. The timepiece of claim 15, the movement cover comprising a tube provided with a collar so as to create a lodging designed to receive a portion of an opening of the dial.

17. The timepiece of claim 1, further comprising at least one tightening means of the removable case body portion relative to the rest of the casing.

18. The timepiece of claim 17, the removable case body portion comprising a grasping means on each of its extremities.

19. The timepiece of claim 1, further comprising at least one spring means capable of partially extracting the removable case body portion from the rest of the case body when the fastening means is actuated so as to remove said removable case body portion.

20. The timepiece of claim 1, the dial being fastened to the removable case body portion through permanent or detachable fastening means.

21. The timepiece of claim 1, in the shape of a wristwatch.

22. A dial designed to be placed in a timepiece or wristwatch according to claim 1.

23. A timepiece with an interchangeable dial, comprising:

a case body with a removable case body portion, said removable case body portion being fastened to the rest of said case body through a fastening means allowing the case body portion to become disunited from the rest of said case body, an interchangeable dial fastened to said removable case body portion, a single, releasable button, wherein said fastening means can be actuated by said single releasable button only, so as to fasten said case body portion to said case body in a first state and to release said case body portion from said case body in a second state, a movement, a movement cover, hands, an axis connecting said hands to said movement, wherein said dial comprises an opening for allowing the axis of the hands to pass without touching the sides of said opening when said removable case body portion is being removed and/or attached to said case, a tube around said axis, and a mark support placed on a portion of the movement cover facing the axis of the hands opposite that which adjoins the removable case body portion, said mark being designed to hide said opening.

24. A timepiece with an interchangeable dial, comprising:

a case body with a removable case body portion, said case body portion being fastened to the rest of said case body through a fastening means allowing said case body portion to become disunited from the rest of said case body, an interchangeable dial fastened to said removable case body portion, and a turning bezel, wherein said fastening means can be actuated by the turning bezel, so as to fasten said case body portion to said case body in a first state and to release said case body portion from said case body in a second state, wherein the fastening means comprises a fastening piece fastened to the removable case body portion designed to work with the turning bezel that is an integral part of said timepiece.

25. The timepiece of claim 24, wherein the turning bezel comprises an opening and a lodging capable of receiving said fastening piece according to a first angular position of the bezel and to lock said fastening piece according to a second angular position of the bezel, respectively freeing and locking said removable case body portion.

26. A timepiece with interchangeable dial, comprising:

a case body with a removable case body portion, said case body portion being fastened to the rest of said case body through a fastening means allowing said case body portion to become disunited from the rest of said case body, an interchangeable dial fastened to said removable case body portion, and a single, releasable actuating means operable with one finger only, wherein said fastening means can be actuated by said single releasable actuating means only, so as to fasten said case body portion to said case body in a first state and to release said case body portion from said case body in a second state.

* * * * *